US005485820A

United States Patent [19]

Iwaszkiewicz

[11] Patent Number: 5,485,820

[45] Date of Patent: Jan. 23, 1996

[54] INJECTION CONTROL PRESSURE STRATEGY

[75] Inventor: Titus Iwaszkiewicz, Woodridge, Ill.

[73] Assignee: Navistar International Transportation Corp., Chicago, Ill.

[21] Appl. No.: 300,292

[22] Filed: Sep. 2, 1994

[51] Int. Cl.[6] ..... F02M 41/00

[52] U.S. Cl. ..... 123/458; 123/446

[58] Field of Search ..... 123/456, 458, 123/446, 179.17, 501

[56] References Cited

U.S. PATENT DOCUMENTS

| | | | |
|---|---|---|---|
| 5,121,730 | 6/1992 | Ausman et al. | 123/467 |
| 5,176,115 | 1/1993 | Campion | 123/179.17 |
| 5,181,494 | 1/1993 | Ausman et al. | 123/179.17 |
| 5,191,867 | 3/1993 | Glassey | 123/446 |
| 5,245,970 | 9/1993 | Iwaskiewicz et al. | 123/447 |
| 5,313,924 | 5/1994 | Regueiro | 123/456 |
| 5,357,912 | 10/1994 | Barnes et al. | 123/446 |
| 5,357,929 | 10/1994 | McCandless | 123/458 |

OTHER PUBLICATIONS

"HEUI—A New Direction for Diesel Engine Fuel Systems", S. F. Glassey et al. SAE Paper No. 930270, Mar. 1993.

*Primary Examiner*—Thomas N. Moulis
*Attorney, Agent, or Firm*—Dennis K. Sullivan

[57] ABSTRACT

A system for controlling fuel injection in a diesel engine that includes a hydraulically-actuated, electronically-controlled unit injector (HEUI) fuel system. The injection rate/pressure characteristic of a HEUI fuel system is a function of oil supply (rail) pressure, which is independent of engine speed and load. However, transient operating conditions necessitate rapid changes in rail pressure and the prior art system does not always respond to these rapid changes fast enough. The enhanced control system of this invention incorporates a more sophisticated feed forward control term by changing the feed forward calibration from a lookup function based only on desired rail pressure to a lookup table based on desired rail pressure and RPCV flow and which has been found to be responsible for benefits in transient emissions and engine response and performance.

7 Claims, 6 Drawing Sheets

INJECTION CONTROL PRESSURE STRATEGY

CROSS-REFERENCES

The present application is related to U.S. Pat. Nos. 5,121,730 5,191,867 and 5,245,970 which disclose diesel engines having HEUI fuel systems. The invention of U.S. Pat. No. 5,121,730 is to detect the temperature and/or viscosity of the actuating fluid in the unit injectors of a HEUI fuel system, prior to actuating the actuation fluid pump, and expelling or heating up actuating fluid prior to cranking the engine if its conditions are such that quick starting of the cold engine may be hindered. The invention of U.S. Pat. No. 5,191,867 is the provision of an electronically controlled rail pressure control valve for controlling the pressure of the hydraulic actuating fluid, i.e., lube oil, and for correcting the pressure amount based on the sensed pressure of the hydraulic actuating fluid using closed-loop control of the actuating fluid pressure. The invention of U.S. Pat. No. 5,245,970 is the provision of an actuating fluid compensator that includes a priming reservoir in fluid communication with a passageway that extends between the unit fuel injector and the high pressure pump that functions to prevent the occurrence of voids within the actuating fluid system. Both of these patents are incorporated herein by this reference.

BACKGROUND OF THE INVENTION

In a Hydraulically-actuated Electronically-controlled Unit Injector fuel system, hereinafter referred to as a HEUI system, engine oil is drawn from the sump by the engine oil pump and flows to a high pressure supply pump which pressurizes the oil to between 450 and 3,000 psi. The outlet pressure of the high pressure supply pump is determined by the Rail Pressure Control Valve (hereinafter RPCV). High pressure oil from the RPCV is supplied to rails or manifolds that are cast into each cylinder head, from which it is constantly available to the fuel injectors. The pressure maintained by the RPCV is determined by a variable electrical current, hereinafter referred to as the duty cycle, that is supplied by the Electronic Control Module (hereinafter ECM). The ECM is a microprocessor which monitors various engine sensors and then computes a pair of output control signals. The ECM selects a fuel injector and sends an output signal to the Electronic Drive Unit (hereinafter EDU) which completes a circuit to the solenoid of the selected fuel injector. The energized fuel injector solenoid lifts the injector poppet valve off its seat which enables high pressure oil from the rail to enter the fuel injector causing injection of fuel into the engine cylinder. Injection of fuel stops when the ECM signals the EDU to stop transmitting the current to the injector solenoid. When this current stops, the popper spring then causes the poppet to close.

The actual rail pressure is sensed and transmitted to the ECM. The ECM utilizes the data from the various sensors to calculate a set point which is a calculated desired rail pressure. The difference between the set point and the actual rail pressure, is hereinafter referred to as the tracking error. The control strategy of the ECM includes lookup feed forward terms corresponding to tracking errors. The feed forward term is a first guess or calculation of the duty cycle needed to eliminate the tracking error. If the tracking error is not eliminated in the first cycle the cycle is repeated and a new duty cycle is calculated and transmitted to the solenoid of the RPCV which results in a further adjustment in the actual rail pressure. This closed loop system continues to recycle and to reduce the value of the tracking error. Recycling is time consuming and it is apparent that the accuracy of the look up feed forward term is critical to fast and accurate rail pressure adjustments.

An assumption of the control strategy, of the prior art HEUI system, is that the feed forward calibration is solely a function of the desired rail pressure. The ECM is programmed to be consistent with this assumption and selects a feed forward term accordingly. This assumption does not take into consideration the fact that engine operating conditions, such as operating speed and load, have a significant effect on RPCV flow and thus on the duty cycle required to attain a given rail pressure. Different operating conditions can require duty cycle swings of up to 3.5% for a given rail pressure.

Fast and accurate rail pressure control is essential to achieve optimum performance from HEUI fuel systems. However in prior art HEUI systems, for example, those disclosed in the above-identified U.S. Pat. Nos. 5,121,730 5,191,867 and 5,245,970, control tracking error has been observed when calibrating these engines especially under transient operating conditions. Tracking error, which is the difference between desired rail pressure and actual rail pressure, occurs when the control system cannot respond fast enough to accomplish the desired oil pressure change. Tracking error is affected by control system response time and the rail pressure information update rate. Tracking error adversely affects engine emissions, response time, fuel economy and performance.

For the foregoing reasons, there is a need to enhance the rail pressure control strategy used in HEUI systems, to improve the feed forward term and reduce the time required to reach a desired rail pressure.

SUMMARY OF THE INVENTION

The present invention relates generally to a system for controlling fuel injection in diesel engines and, more particularly, to a system for controlling fuel injection in a diesel engine that includes a HEUI fuel system. The rate/pressure injection characteristic for a HEUI fuel system is a function of multiple engine conditions that are constantly being monitored and thus has the ability to respond to any engine condition. Because the HEUI fuel system is hydraulically actuated rather than mechanically actuated, its rate/pressure injection characteristic is not dependent on engine speed. The injection rate/pressure characteristic of a HEUI fuel system is a function of oil supply (rail) pressure, which is independent of engine speed and load. As a result a HEUI fuel system can provide a diesel engine with an optimum injection characteristic, regardless of the engine's operating mode. However, transient operating conditions necessitate rapid changes in rail pressure and the prior art system does not always respond to these rapid changes fast enough.

The enhanced control system of this invention incorporates a more sophisticated feed forward control term wherein the feed forward calibration is based on desired rail pressure and RPCV flow and which has been found to be responsible for benefits in transient emissions and engine response and performance.

DETAILED DESCRIPTION OF THE PREFERRED EMBODIMENT

Figure 1:
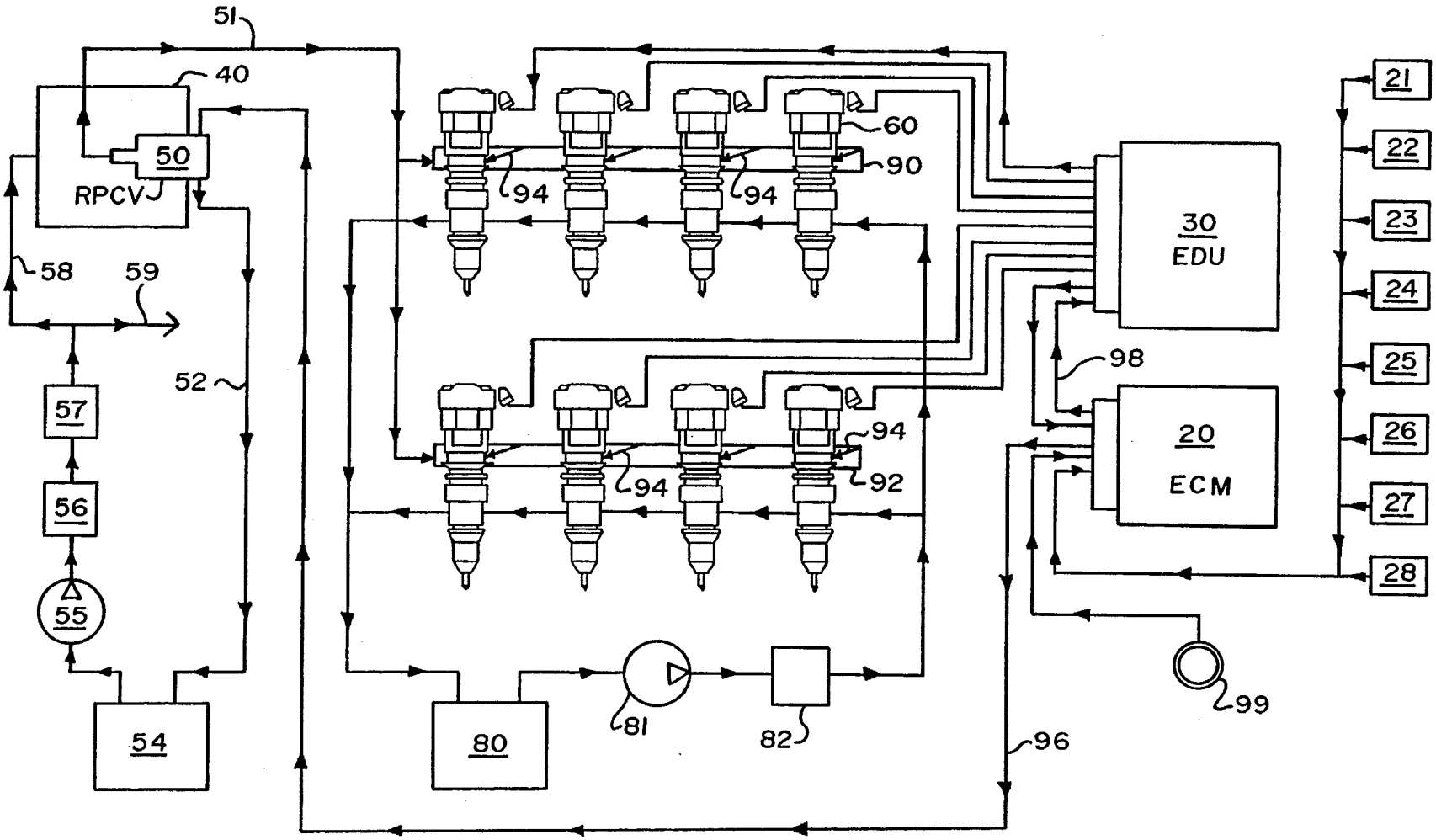
FIG. 1 is a diagrammatic general schematic view of a hydraulically-actuated electronically-controlled unit injector fuel system, for an internal combustion engine having a plurality of unit injectors.

The HEUI system will now be described with reference to FIGS. 1 and 2. For a more detailed description, reference should be had to the above-identified U.S. Pat. Nos. 5,121,730 and 5,245,970.

The HEUI system which consists of five major components will be described in general terms with respect to FIG. 1. The five major components of the HEUI system are:

1. Electronic control Module 20 (hereinafter ECM);
2. Electronic Drive Unit 30 (hereinafter EDU);
3. High pressure oil supply pump 40;
4. Rail Pressure Control Valve 50 (hereinafter RPCV); and
5. HEUI injectors 60.

The ECM 20 is a microprocessor which monitors various engine sensors 21–28. The ECM 20 is programmed with the operating strategy of the HEUI system and controls the operation of the entire fuel system. The ECM 20 calculates the desired rail pressures for specific engine conditions and controls the EDU 30 which sends current pulses to the injector solenoids. The engine has eight sensors which constantly monitor performance and operating conditions. The job of each sensor is to accurately monitor a specific engine condition and generate a signal voltage to send through the vehicle wiring harness to the ECM 20. Sensor 21 monitors accelerator position, sensor 22 monitors camshaft position, sensor 23 monitors injection control pressure, sensor 24 monitors boost pressure, sensor 25 monitors oil temperature, sensor 26 monitors ambient air temperature, sensor 27 monitors barometric pressure and sensor 28 monitors exhaust back pressure. The ECM 20 computes a pair of output control signals 96 and 98. Signal 96 is the duty cycle that is directed to the RPCV 50. The RPCV 50 functions to adjust the output pressure of the pump 40 which in turn determines the pressure of the actuating fluid in the rails 90 and 92. An output control signal 98 determines the time for starting fuel injection and the quantity of fuel to be injected during each injection phase. The output control signal 98 causes a selected waveform to be directed to an injector solenoid 61.

The high pressure oil supply pump 40 is driven by the engine, and must have the capacity to meet the engine's peak torque requirements. At peak torque, an engine is rotating at a relatively low rate, for example about 2,000 revolutions per minute, and, accordingly, drives the actuating fluid pump at a relatively low rate. In the preferred embodiment, the high pressure oil supply pump 40 is driven at 86% of the engine speed and thus at peak torque, the high pressure oil supply pump is rotating at about 1720 revolutions per minute.

During normal engine operation, pump output pressure is controlled by the RPCV 50. The RPCV 50 is an electrically operated dump valve which closely controls pump output pressure by dumping excess flow back to the engine oil sump 54 through a return passage 52. An engine oil pump 55 pumps oil from the sump 54 through an oil cooler 56 and an oil filter 57. Oil from the oil filter 57 can flow either through a passageway 58 to the high pressure oil supply pump 40 or through passageway 59 to the engine lubrication system.

A variable signal current 96, also referred to as the duty cycle, flows from the ECM 20 to the RPCV 50 and determines pump output pressure. The duty cycle has a constant voltage and is a modulated or square wave current that is expressed as a percentage. The extremes of 100% being a DC signal and 0% being an open circuit. Percentages between the extremes indicating percent in time that the signal is on. Pump pressure can be maintained anywhere between 450 psi and 2,750 psi during normal engine operation. Oil under pressure flows from the RPCV outlet through a passage 51 to rails 90 and 92 that are cast into each cylinder head and from which the oil under pressure is constantly available to the fuel injectors through passages 94.

Figure 2:
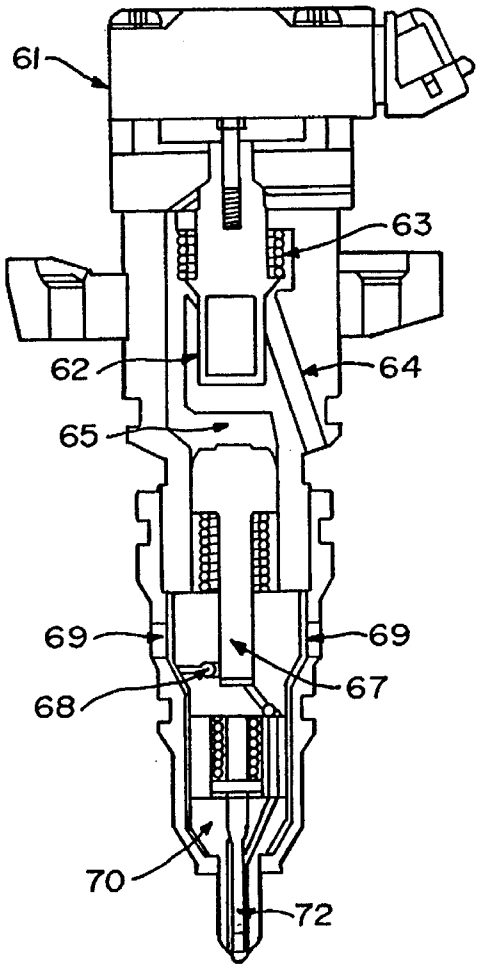
FIG. 2 is a diagrammatic partial cross-sectional view of a unit injector, of the type shown in FIG. 1.

Referring now to FIG. 2, an injector 60 will be described. It should be understood that the engine disclosed herein is an eight cylinder engine of the type having two banks of four cylinders. Since the injectors are identical, only one injector 60 will be described. The HEUI injectors 60 uses the hydraulic energy of the pressurized oil to cause injection. The injector has an electronic solenoid 61 that can be energized by a signal from the EDU 30. The electronic solenoid 61 is a very fast acting electromagnet, which when energized, pulls the poppet valve 62 off its seat. The popper valve 62 is held on its seat by a spring 63. When the poppet valve 62 is held closed by spring 63, high pressure inlet oil is blocked from entry through the actuating fluid inlet passage 64 and the intensifier cavity 65 is opened to drain. When solenoid 61 is energized, the popper valve 62 is quickly lifted off its seat and the path to drain is closed and the inlet passage 64 for high pressure oil is opened. When the popper valve 62 opens the fluid inlet passage 64, high pressure oil enters the injector 60 and acts on the top of the intensifier piston 66. Pressure builds on the intensifier piston 66, pushing it and its plunger 67 down. The intensifier piston 66 is seven times larger in surface area than its plunger 67, providing an equal multiplication of force. The downward movement of the plunger pressurizes the fuel in the plunger cavity, causing the nozzle 71 to open. The nozzle assembly 70 includes a check ball 68 that seats and seals during the downward stroke of the plunger 67 to prevent leakage of the high pressure fuel. During the return stroke, the check ball 68 unseats allowing the plunger cavity to fill with fuel through the fuel inlet holes 69.

Fuel is drawn from the fuel tank 80 by a mechanical fuel pump 81 and flows through a filter 82 to each cylinder head. In the preferred embodiment, fuel is supplied to each injector by means of internal fuel supply galleries in the engine head.

In the preferred embodiment, the nozzle valve is an inwardly opening type which lifts off its seat when pressure overcomes the spring force. Fuel is then atomized at high pressure through the nozzle tip.

The pressure of the incoming oil controls the speed of the intensifier piston 66 and plunger movement, and therefore, the rate/pressure injection characteristic. The amount of fuel injected is determined by the duration of the duty cycle from the EDU 30 and how long it keeps the solenoid 61 energized.

Fast and accurate rail pressure control is of utmost importance to the HEUI fuel system. Significant rail pressure errors have been noted on occasion when calibrating an engine. Rail pressure errors occur most often under transient operating conditions, for example, when returning to idle.

An assumption in the prior art control system strategy is that the duty cycle required to obtain a desired rail pressure is solely a function of the desired rail pressure. However, operating conditions of the engine such as operating speed and load also effect rail pressure for a given duty cycle. The following example of how engine operating conditions can vary illustrates this point. At 5 MPa, the engine operating conditions can vary from 650 rpm at ¾ load to 3300 rpm at no load with numerous conditions in between.

Figure 3:
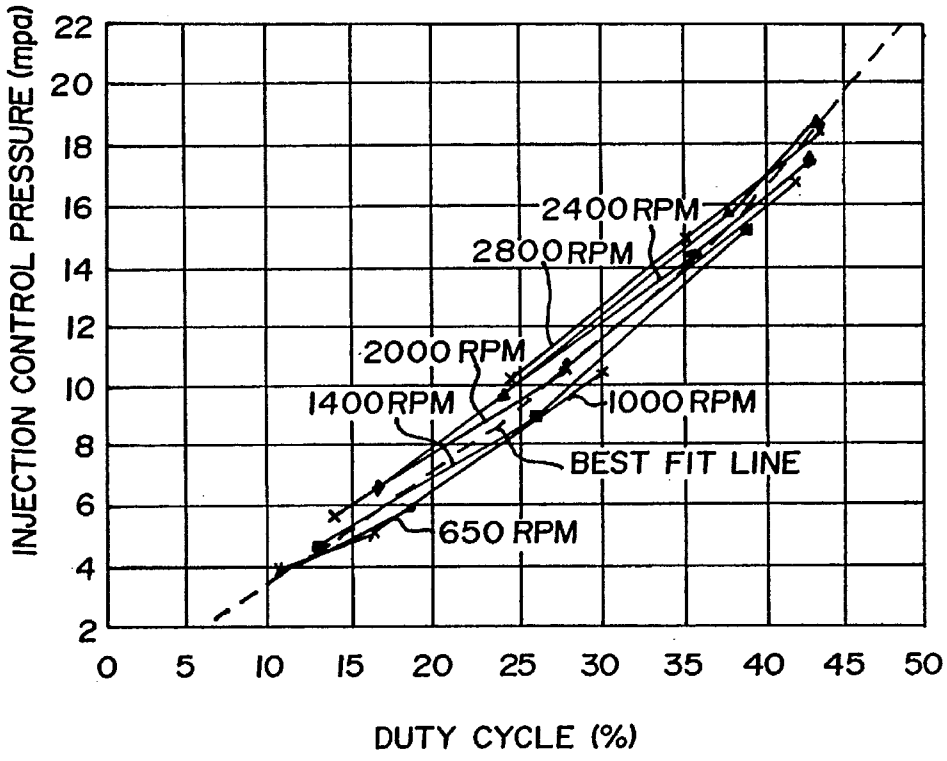
FIG. 3 is a chart illustrating how the prior art duty cycle is calculated.

Reference is made to FIG. 3 which is a chart illustrating how the prior art duty cycle is calculated. In FIG. 3, Duty Cycle % is plotted on the X axis and Desired Rail Pressure on the Y axis. A family of curves have been plotted, each curve representing the engine at a particular operating speed expressed in revolutions per minute. A best fit line has been drawn through this family of curves. In the prior art operating strategy, the duty cycle for a desired rail pressure was determined by this best fit line. It is apparent from this chart that at a desired rail pressure, for example at 8 MPa, the best fit line indicates a duty cycle of approximately 22%. However, the actual curves at 8 MPa are spread over a range from 20% to 24%. Since usable operating range of actuator duty cycles is approximately 5 to 50%, a 4% duty cycle spread represents in excess of 8% of the operating range. Thus, when a duty cycle is selected from the best fit line of FIG. 3, an acceptable rail pressure change will not always be reached on the first cycle. Several cycles may be required to reach the desired rail pressure. This multiple cycling is time consuming and defeats the objective of fast rail pressure control. In return-to-idle tests, it was found that desired rail pressure was not achieved for 3 to 4 seconds after it had been commanded. This can cause under-run and rough operation which may be aggravated by oil aeration to cause very rough idle.

Figure 4:
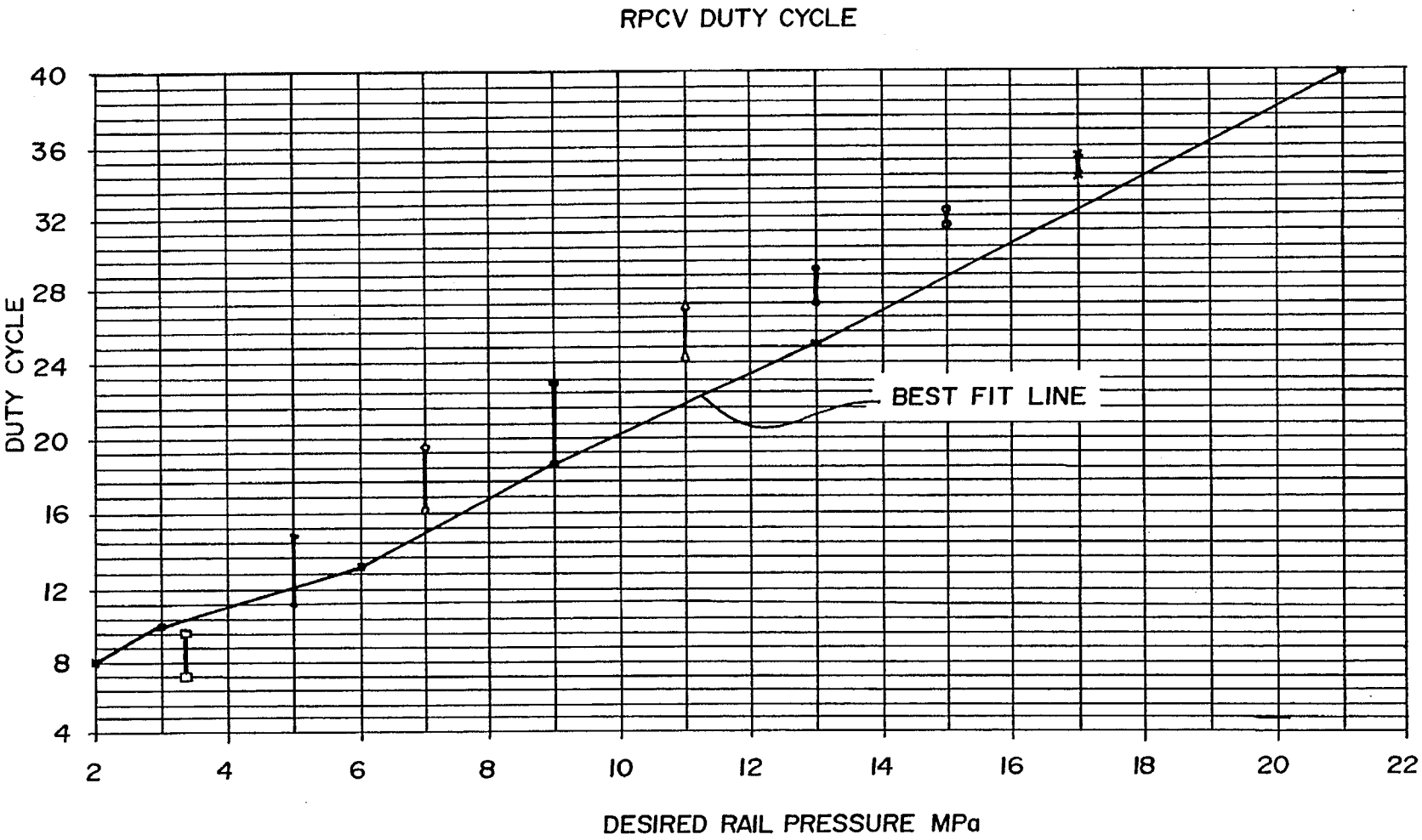
FIG. 4 is a chart showing the feed forward calculation or best fit line of the prior art operating strategy.

Referring now to FIG. 4, which is a chart on which Desired Rail Pressure MPa is plotted on the X axis and Duty Cycle is plotted on the Y axis. The feed forward calculation or best fit line of the prior art operating strategy is shown on this chart. Also shown on this chart are actual measured duty cycles that are required to obtain rail pressures under different operating conditions. For example, a duty cycle of from 7% to 9% is required to reach a desired rail pressure of 3.4 MPa depending upon the engines operating condition. The wide range of required duty cycle over the span of operating conditions is especially obvious at low rail pressures. Low rail pressures are particularly sensitive to error due to injector gains being low and the wide range of operating conditions encountered. Injector gains are very sensitive to rail pressure; at 4 MPa, fuel delivery is limited to a maximum of 29 cubic millimeters while at 3 MPa, the maximum delivery is only about 8 cubic millimeters.

When engine operating conditions change, there is a corresponding change in the flow through the RPCV and thus to improve the accuracy of the first guess duty cycle, consideration must be given to the RPCV flow at the desired rail pressure. Therefore, according to this invention, the engine operating condition will be compensated for by changing the feed forward calibration from a lookup function based only on desired rail pressure to a lookup table based on desired rail pressure and RPCV flow. This can be accomplished by programming the ECM software to calculate RPCV flow according to the following formula:

$$\text{RPCV flow} = \text{supply pump flow} - \text{injector demand flow}$$

where:

supply pump flow=pump capacity per revolution×pump speed×volumetric efficiency

The high pressure oil supply pump 40 used in the preferred embodiment has a capacity of 6.5 cc per revolution, is driven by the engine at 86% of the engine's operating speed and has a volumetric efficiency of about 98%. Thus the supply pump flow for the high pressure oil supply pump 40 used in the preferred embodiment is equal to: 5.47 (cc/rev)×engine speed (RPM) or 5.47×engine speed (cc/min).

$$\text{injector demand flow} = \text{engine speed (RPM)} \times \text{fuel delivered (cu mm/stroke)} \times \text{strokes per revolution} \times \text{oil to fuel ratio} \times 1\ \text{cc/1000 cu mm}$$

In the injectors used in the preferred embodiment, the engine has four strokes per revolution and the oil to fuel ratio is 15. Thus the injector flow equals 0.06×engine speed (RPM)×fuel delivered (cu mm/stroke).

The formula (RPCV flow=supply pump flow−injector demand flow) can be simplified for the preferred embodiment engine as follows:

$$RPCV\ \text{flow (1 pm)} = \frac{\text{Engine Speed } (5.47 - 0.06 \times \text{fuel delivery})}{1000}$$

This formula can of course be expressed in a general form for application to different engines and different high pressure oil supply pumps. Thus, in the above formula, 5.47 can be expressed as K1 and 0.06 can be expressed as K2 and the formula would be as follows:

$$RPCV\ \text{flow (1 pm)} = \frac{\text{Engine Speed } [K1 - K2(\text{fuel delivery})]}{1000}$$

where

K1=pump capacity/revolution×pump rpm/engine rpm×pump volumetric efficiency

K2=injector oil demand flow×strokes per revolution×1 cc/1000 cu mm

The following TABLE 1, in which engine speed is represented by N and fuel delivery by VFDES, includes engine tests of this new operating strategy performed on a 7.3 liter diesel engine.

TABLE 1

| N rpm | VFDES cu mm | fuel rate lb/hr | pump cc/min | inj flow cc/min | rpcv flow lpm | icp duty % |
|---|---|---|---|---|---|---|
| | | | ICP = 3.4 MPa | | | |
| 650 | 37.8 | 4.4 | 3555.5 | 1466.4 | 2.09 | 9.57 |
| 650 | 18.9 | 4.5 | 3555.5 | 737.1 | 2.82 | 9.47 |
| 650 | 9.7 | 2 | 3555.5 | 378.3 | 3.18 | 9.67 |
| 650 | 4.4 | 1.6 | 3555.5 | 171.6 | 3.38 | 9.77 |
| 900 | 0 | 0 | 4923 | 0 | 4.92 | 8.50 |
| 1200 | 0 | 0 | 6564 | 0 | 6.56 | 7.81 |
| 1400 | 0 | 0 | 7658 | 0 | 7.66 | 7.13 |
| | | | ICP = 5.0 MPa | | | |
| 650 | 37.5 | 10.7 | 3555.5 | 1462.5 | 2.09 | 14.65 |
| 650 | 31.3 | 8.8 | 3555.5 | 1220.7 | 2.33 | 14.75 |
| 1400 | 27.8 | 17.2 | 7658 | 2335.2 | 5.32 | 13.48 |
| 1400 | 12.6 | 8 | 7658 | 1058.4 | 6.60 | 13.28 |
| 2200 | 27.5 | 26.9 | 12034 | 3630 | 8.40 | 12.50 |

TABLE 1-continued

| N rpm | VFDES cu mm | fuel rate lb/hr | pump cc/min | inj flow cc/min | rpcv flow lpm | icp duty % |
|---|---|---|---|---|---|---|
| 2200 | 12.6 | 11.7 | 12034 | 1663.2 | 10.37 | 12.11 |
| 3300 | 18.8 | 23.7 | 18051 | 3722.4 | 14.33 | 11.52 |
| 3300 | 12.5 | 13 | 18051 | 2475 | 15.58 | 11.33 |
| | | | ICP = 7.0 MPa | | | |
| 650 | 45 | 11.7 | 3555.5 | 1755 | 1.80 | 19.49 |
| 650 | 40.5 | 10.8 | 3555.5 | 1579.5 | 1.98 | 19.24 |
| 1400 | 35.3 | 21.3 | 7658 | 2965.2 | 4.69 | 18.75 |
| 2200 | 27.5 | 25.2 | 12034 | 3630 | 8.40 | 17.78 |
| 3300 | 19 | 27.5 | 18051 | 3762 | 14.29 | 16.50 |
| 3300 | 13.3 | 20 | 18051 | 2633.4 | 15.42 | 16.21 |
| | | | ICP = 9.0 MPa | | | |
| 1200 | 38.1 | 18.2 | 6564 | 2743.2 | 3.82 | 23.15 |
| 1800 | 28.6 | 22.33 | 9846 | 3088.8 | 6.76 | 22.36 |
| 2200 | 27.5 | 26.8 | 12034 | 3630 | 8.40 | 22.85 |
| 3300 | 18.8 | 25.8 | 18051 | 3722.4 | 14.33 | 20.12 |
| | | | ICP = 11.0 MPa | | | |
| 900 | 41.1 | 15.4 | 4923 | 2219.4 | 2.70 | 27.15 |
| 1200 | 42 | 21 | 6564 | 3024 | 3.54 | 26.76 |
| 1800 | 37.6 | 28.3 | 9846 | 4060.8 | 5.79 | 26.08 |
| 2200 | 33.8 | 32.3 | 12034 | 4461.6 | 7.57 | 25.69 |
| 3300 | 28.8 | 39.4 | 18051 | 5702.4 | 12.35 | 24.42 |
| | | | ICP = 13.0 MPa | | | |
| 1400 | 44.6 | 26.1 | 7658 | 3746.4 | 3.91 | 29.20 |
| 2200 | 37.6 | 35.75 | 12034 | 4963.2 | 7.07 | 28.72 |
| 3300 | 38.8 | 52.9 | 18051 | 7682.4 | 10.37 | 28.13 |
| 3300 | 19.2 | 21.8 | 18051 | 3801.6 | 14.25 | 27.25 |
| | | | ICP = 15.0 MPa | | | |
| 1400 | 61.8 | 36.2 | 7658 | 5191.2 | 2.47 | 32.72 |
| 2200 | 44.1 | 42.6 | 12034 | 5821.2 | 6.21 | 32.03 |
| 3300 | 57.2 | 81.8 | 18051 | 11325.6 | 6.73 | 32.42 |
| 3300 | 39 | 54.65 | 18051 | 7722 | 10.33 | 31.64 |
| | | | ICP = 17.0 MPa | | | |
| 2200 | 68 | 63.3 | 12034 | 8976 | 3.06 | 35.26 |
| 3300 | 62.8 | 90.1 | 18051 | 12434.4 | 5.62 | 35.35 |
| 3300 | 38.3 | 54.3 | 18051 | 7583.4 | 10.47 | 34.38 |

Figure 5:
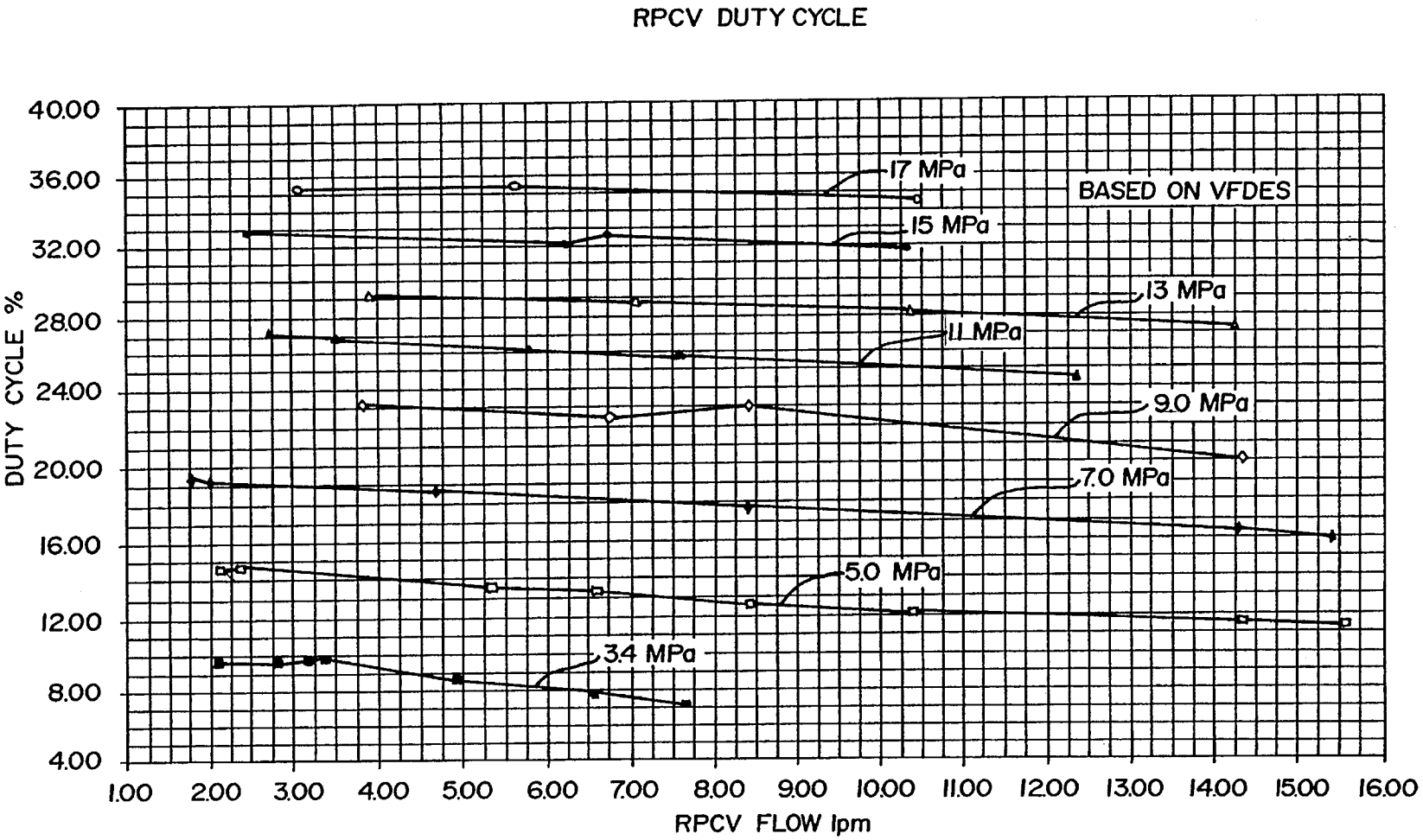
FIG. 5 is a chart that is based on the data contained in TABLE that depict the relationship between RPCV flow, desired rail pressure and duty cycle.
Figure 6:
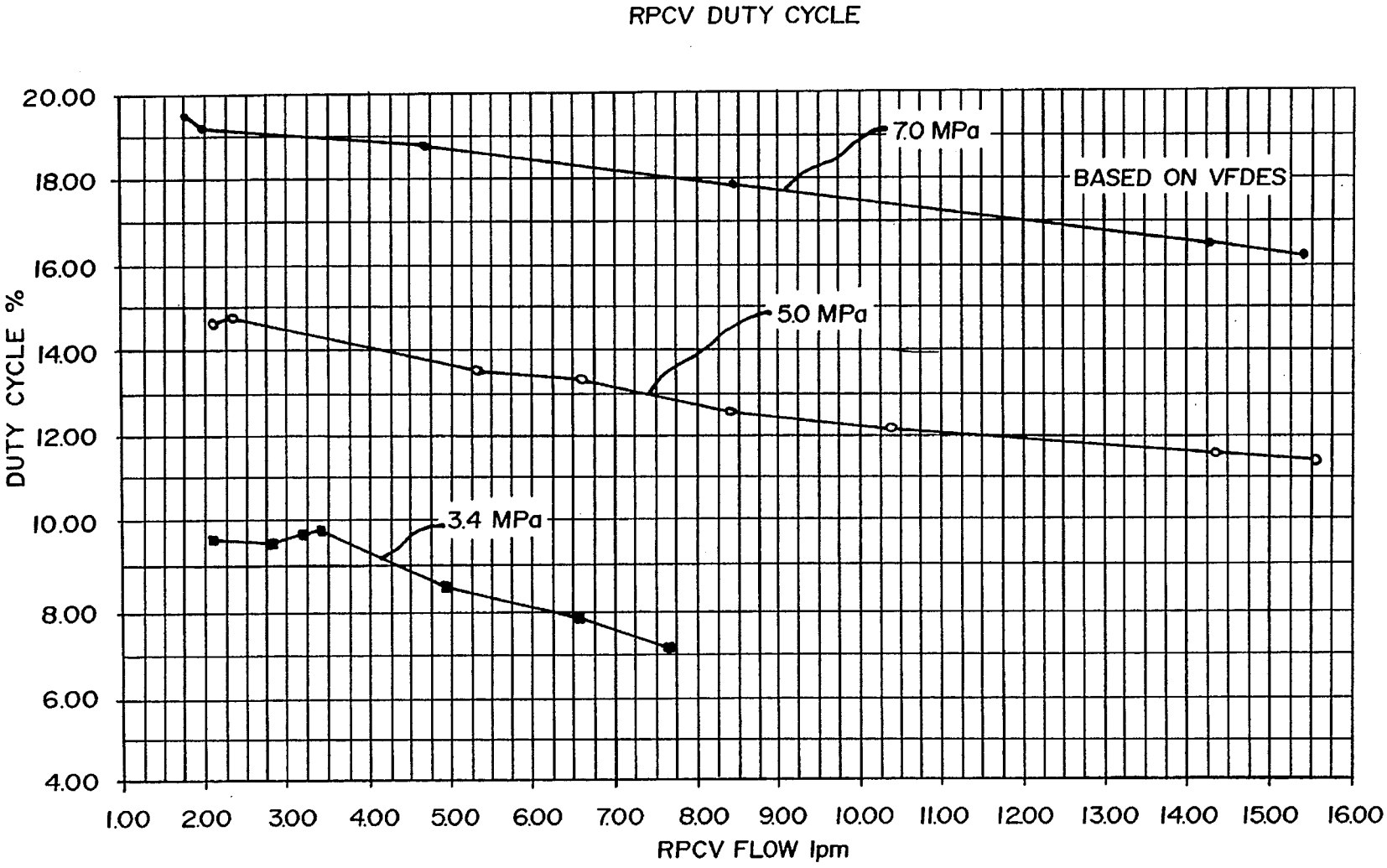
FIG. 6 is a chart showing three of the curves from Fig. in a larger scale.

FIGS. 5 and 6 are charts, based on the data contained in TABLE 1, that depict the relationship between RPCV flow, desired rail pressure and duty cycle. It should be noted that FIG. 5 includes curves for eight different desired rail pressures and FIG. 6 repeats three of these curves but at a larger scale.

Figure 7:
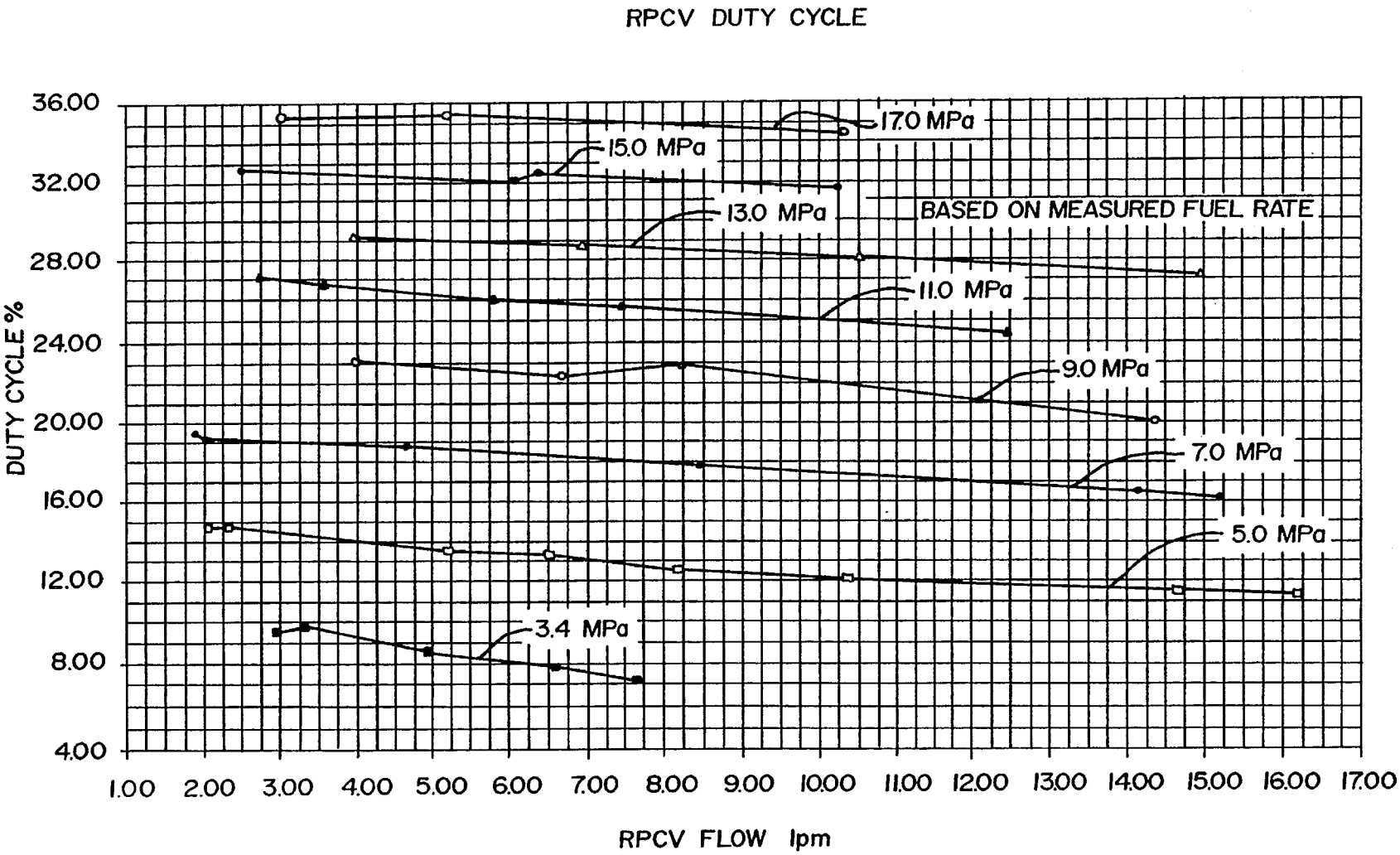
FIG. 7 is a chart that is based on actual measured fuel rate in an engine using the improved operating strategy.

FIG. 7 is a chart showing duty cycle required for various pressures and RPCV flow in which the RPCV flow are based upon actual measured fuel rates. When the corresponding curves on FIGS. 6 and 7 are compared there is a very good correlation between actual fuel used and that calculated by the improved operating strategy.

It is intended that the accompanying Drawings and foregoing detailed description are to be considered in all respects as illustrative and not restrictive, the scope of the invention is intended to embrace any equivalents, alternatives, and/or modifications of elements that fall within the spirit and scope of the invention, and all changes which come within the meaning and range of equivalency of the claims are therefore intended to be embraced therein.

What is claimed is:

1. In a diesel engine having a hydraulically-operated, electronically-controlled fuel injector operating system of the type having fuel injectors, a high pressure injector fluid pump, a rail pressure control valve for the high pressure injector fluid pump, a rail connected by a passage to the outlet of said control valve, a passage from said rail to individual injectors, an electronic control module that is programmed with the operating strategy for the hydraulically-operated, electronically-controlled fuel injector operating system, senses engine conditions and is further programmed to use the sensed data to calculate a desired injection fluid rail pressure and to send a duty signal to said rail pressure controlled valve that will cause the control valve to adjust the rail pressure toward the calculated desired injection fluid rail pressure, a fuel supply connected to said injectors, electronically control valves in said injectors for controlling the application of said actuating fluid to cause injection of fuel from said injectors, wherein the improvement comprises:

the operating strategy for the hydraulically-operated, electronically-controlled fuel injector operating system including a duty cycle lookup function based upon desired rail pressure and rail pressure control valve flow from which the duty cycle is selected and transmitted to the rail pressure control valve.

2. The method of adjusting the rail pressure in a hydraulically-operated, electronically-controlled fuel injector operating system of the type having a plurality of fuel injectors, a high pressure injector fluid pump, a rail pressure control valve for the high pressure injector fluid pump, a rail connected by a passage to the outlet of said control valve, a passage from said rail to individual injectors, an electronic control module that senses engine conditions and is programmed to use the sensed data to calculate a desired injection fluid rail pressure and to send a duty signal to said rail pressure controlled valve that will cause the control valve to adjust the rail pressure toward the calculated desired injection fluid rail pressure, a fuel supply connected to said injectors, electronically control valves in said injectors for controlling the application of said actuating fluid to cause injection of fuel from said injectors, comprising the steps of:

(a) providing a duty cycle lookup table having desired rail pressure on one axis and rail pressure control valve flow on the other axis;

(b) calculate desired rail pressure;

(c) calculate rail pressure control valve flow;

(d) select the duty cycle from the duty cycle lookup table using the calculated desired rail pressure and rail pressure control valve flow; and (e) transmit the selected duty cycle to the rail pressure control valve.

3. The invention as set forth in claim 2 wherein when performing the step of calculating the rail pressure control valve flow an equation stating that rail pressure control valve flow is equal to the high pressure injector fluid pump flow less the injector demand flow is applied and the following step is followed to calculate the high pressure injector pump flow:

(f) multiply the high pressure pump flow per revolution by the high pressure pump speed by the volumetric efficiency of the high pressure pump.

4. The invention as set forth in claim 2 wherein when performing the step of calculating the rail pressure control valve flow an equation stating that rail pressure control valve flow is equal to the high pressure injector fluid pump flow less the injector demand flow is applied and the following step is followed to calculate the injector demand flow:

(g) multiply the engine speed by the fuel delivered per stroke by the strokes per revolution by the ratio of the injector oil demanded to the fuel delivered divided by 1000.

5. The invention as set forth in claim 3 wherein when performing the step of calculating the rail pressure control valve flow an equation stating that rail pressure control valve flow is equal to the high pressure injector fluid pump flow less the injector demand flow is applied and the following step is followed to calculate the injector demand flow:

(g) multiply the engine speed by the fuel delivered per stroke by the strokes per revolution by the ratio of the injector oil demanded to the fuel delivered divided by 1000.

6. The invention as set forth in claim 2 wherein in performing the step of calculating the rail pressure control valve flow an equation stating that rail pressure control valve flow is equal to the high pressure injector fluid pump flow less the injector demand flow is applied and the following step is followed to calculate the high pressure injector fluid pump flow:

(f) multiply the high pressure pump flow per revolution by the drive ratio of the high pressure pump to the engine speed by the engine speed by the volumetric efficiency of the high pressure pump.

7. The invention as set forth in claim 6 wherein when performing the step of calculating the rail pressure control valve flow an equation stating that rail pressure control valve flow is equal to high pressure injector fluid pump flow less the injector demand flow is applied and the following step is followed to calculate the injector demand flow:

(g) multiply the engine speed by the fuel delivered per stroke by the strokes per revolution by the ratio of the injector oil demanded to the fuel delivered divided by 1000.

* * * * *